United States Patent [19]

Christiansen

[11] 4,388,067

[45] Jun. 14, 1983

[54] METHOD AND APPARATUS FOR OPERATING A KILN PLANT WITH SOLID FUEL FIRING IN THE PRECALCINING ZONE

[75] Inventor: Soren B. Christiansen, Copenhagen, Denmark

[73] Assignee: F. L. Smidth & Co., Cresskill, N.J.

[21] Appl. No.: 214,976

[22] Filed: Dec. 10, 1980

[30] Foreign Application Priority Data

Dec. 11, 1979 [GB] United Kingdom ..... 7942684

[51] Int. Cl.[3] ..... F27B 15/00

[52] U.S. Cl. ..... 432/14; 110/232; 110/347; 432/106

[58] Field of Search ..... 432/14, 15, 16, 58, 432/106; 110/347, 263, 232, 233

[56] References Cited

U.S. PATENT DOCUMENTS

| | | | |
|---|---|---|---|
| 4,152,110 | 5/1979 | Jukkula et al. | 432/14 |
| 4,236,886 | 12/1980 | Ansen et al. | 432/14 |
| 4,248,639 | 2/1981 | Quittkat | 432/14 X |
| 4,310,298 | 1/1982 | Abelitis | 432/14 |

*Primary Examiner*—Edward G. Favors

*Attorney, Agent, or Firm*—Pennie & Edmonds

[57] ABSTRACT

A kiln plant for burning a pulverous material such as cement, which includes a preheater string for preheating raw material and a precalciner for receiving preheated raw material, the precalciner being fired with solid fuel, and a disintegrator provided adjacent the precalciner. Within the disintegrator the solid fuel, preferably coal, is crushed and mixed with a portion of the preheated raw material before passage into the precalciner. The invention also relates to a unique method for firing in the precalcining zone of the invention kiln plant.

11 Claims, 1 Drawing Figure

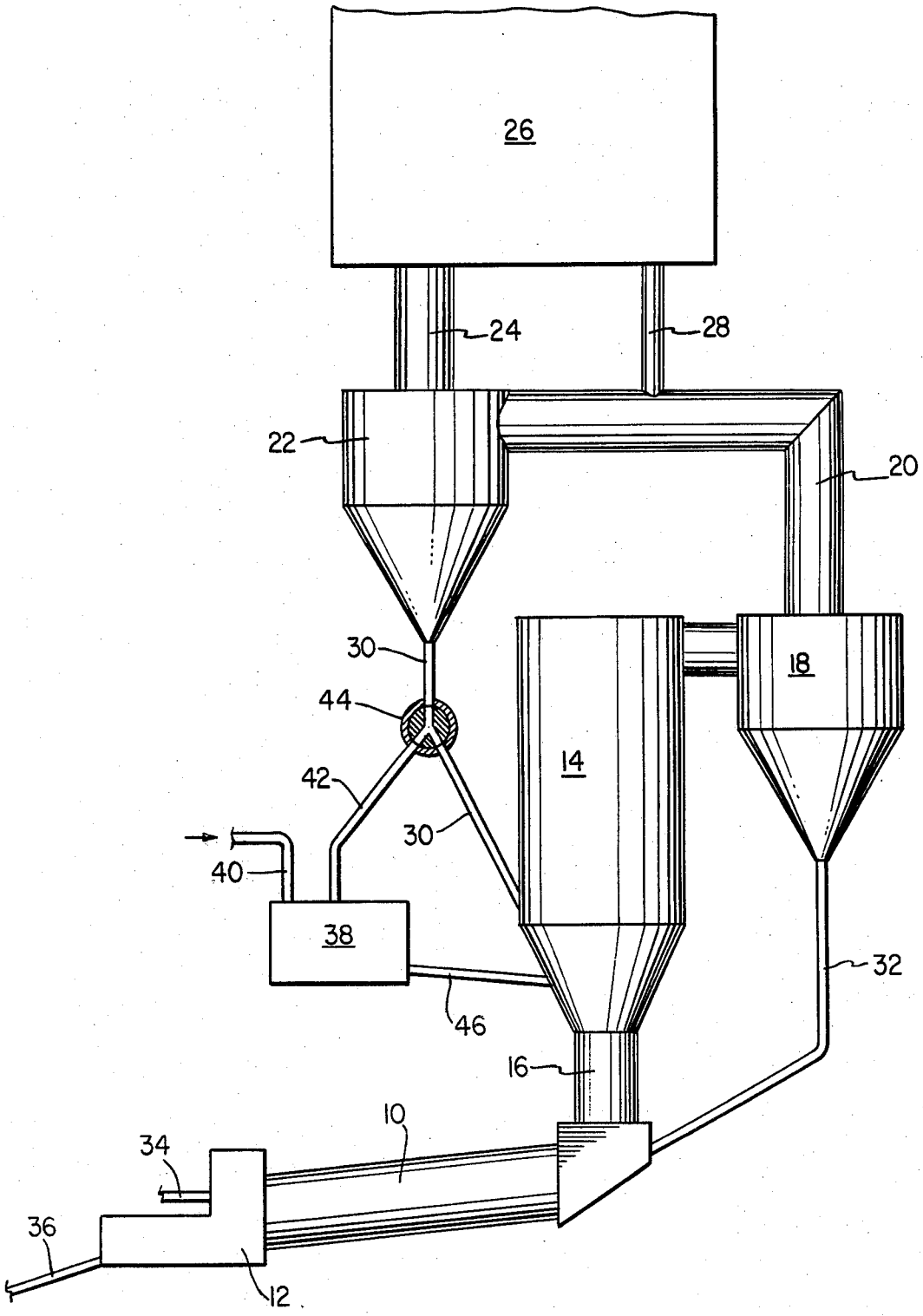
26
24
28
22
20
30
18
44
14
42
30
40
38
32
46
16
10
34
36
12

METHOD AND APPARATUS FOR OPERATING A KILN PLANT WITH SOLID FUEL FIRING IN THE PRECALCINING ZONE

TECHNICAL FIELD

This invention relates to a method of and apparatus for firing in the precalcining zone of a kiln plant for manufacturing pulverous or granular materials such as cement, in accordance with the so called dry process, and in particular for firing with solid fuel, for example coal.

BACKGROUND ART

Typically, kiln plants for manufacturing pulverous or granular materials such as cement consist of one or more preheaters for preheating the raw materials supplied, a kiln for burning and sintering the materials, and a cooler for cooling the product treated in the kiln. The preheating takes place by means of the hot kiln exit gases and/or hot spent cooling air which is passed up through the preheater or preheaters.

In order to reduce the dimensions of such a plant while at the same time achieving an increase in its throughput, a kiln plant may be provided in addition with at least one precalciner for precalcining (i.e., expulsion of $CO_2$) the preheated raw materials prior to passage of these materials to the kiln for the final burning and sintering. Supply of combustion air to such a precalciner is effected by supplying exit gases from the kiln and/or spent cooling air from the cooler as well as by adding a desired amount of atmospheric air to obtain the degree of combustion desired. The precalciner is fed directly with fuel which is mixed with the pulverised raw material in the precalcining zone and burned together with the latter. Subsequently, the precalcined raw materials are passed onto the kiln. In certain kinds of plants, the precalcining does not take place in a separate precalciner, but is arranged to take place in the riser pipe between the kiln and the lowermost preheater stage, the riser pipe being suitably designed for this purpose.

If the fuel used in the precalciner is oil or natural gas, the mixing of the fuel with the pulverised raw material in the precalcining zone does not give rise to major problems in obtaining optimum combustion conditions. However, because of the desire to conserve oil and natural gas resources, it is becoming increasingly popular to use raw coal or other solid fuels for firing in the precalcining zone. In such cases the coal must be crushed prior to the firing in order to achieve the best possible utilization of the coal. Until now, dried and preground coal has normally been used for this purpose although it is also known to feed unground and dried coal into the precalcining zone. In both cases, however, large agglomerations of coal or lumps of coal have been found to be present and to pass the precalcining zone unburned. Thereafter, such agglomerations or lumps fall down through the riser pipe to the kiln proper or end up in the hot air duct through which spent cooling air for the calcining combustion is supplied. Thus, the previous methods have not fully utilized the solid coal in the precalcining zone and have also given rise to problems of clogging both during the pregrinding and during the conveyance of the fuel to the precalcining zone.

DISCLOSURE OF THE INVENTION

The present invention relates to a method of firing with generally solid fuel in a precalcining zone of a kiln plant for burning pulverous or granular material, the kiln plant including at least one preheater for preheating raw material, comprising mixing the generally solid fuel, with at least a portion of the preheated raw material supplied to the precalcining zone, grinding the generally solid fuel together with said portion of preheated raw material, and feeding the ground mixture of generally solid fuel and preheated raw material to the precalcining zone.

In a preferred embodiment, the present invention relates to a method of firing with coal in a precalciner of a kiln plant for burning pulverous or granular material, the kiln plant including a preheater string for preheating raw material supplied to the precalciner, comprising crushing the coal, simultaneously mixing the crushed coal with a portion of the preheated raw material supplied to the precalciner such that the portion of preheated raw material is deposited on the crushed coal as a thin layer so as to prevent agglomeration of the crushed coal, and feeding the mixture of crushed coal and preheated raw material to the precalciner.

The present invention also relates to a plant for burning pulverous or granular material including at least one preheater string for preheating raw material, a kiln for burning the preheated raw material, a cooler for cooling the product treated in the kiln, and a precalcining zone associated with said preheater string for precalcining preheated raw material from the preheater before passage to the kiln, the precalcining zone being fired by generally solid fuel, comprising means for grinding the generally solid fuel, means for simultaneously mixing the generally solid fuel with at least a portion of the preheated raw material from the preheater, and means for feeding the mixture of ground generally solid fuel and preheated raw material to the precalcining zone.

In a preferred embodiment, the present invention relates to a kiln plant supplied with raw material for burning pulverous or granular material including a preheater string for preheating raw material, a kiln for burning the preheated raw material, a cooler for cooling the product treated in the kiln, and a coat-fired precalciner configured and adapted for receiving and precalcining preheated raw material from the preheater before passage to the kiln, comprising means for crushing the coal, means for simultaneously mixing the coal with a portion of the preheated raw material such that the portion of preheated raw material is deposited as a thin layer on the crushed coal so as to prevent agglomeration of the crushed coal, and means for feeding the mixture of crushed coal and preheated raw material to said precalciner.

Preferably, the crushing means is in the form of a disintegrator or crusher. The means for mixing the preheated raw material with the coal includes a splitter gate in communication with the preheater, the precalciner and the disintegrator, the splitter gate being adapted for directing a predetermined portion of the preheated raw material to the disintegrator. Also, the means for feeding the crushed coal and preheated raw material is at least one of a pneumatic and a mechanical conveyor.

Preferably the crusher or disintegrator is provided immediately adjacent the precalciner or precalcining zone. The crusher or disintegrator may have no real drier and does not need to be provided with normal ventilation. Thus it is possible to achieve both low installation and operational costs.

The pulverous preheated raw material fed to the crusher is deposited as a thin layer or a crust on the fuel particles and by such deposit prevents adhesion between the individual fuel particles and between the fuel particles and parts of the crusher and the conveying equipment provided between the crusher and the precalcining zone. The mixing of the solid fuel with raw material prior to the mixture's meeting the combustion air in the precalcining zone is advantageous and in addition the conveyance of fuel through the crusher and conveying equipment to the precalcining zone is improved.

BRIEF DESCRIPTION OF THE DRAWING

The present invention is described in detail below with reference to the partly schematic and partly diagrammatic accompanying drawing of a kiln plant according to the present invention.

DESCRIPTION OF THE BEST MODE FOR CARRYING OUT THE INVENTION

Referring to the drawing, a plant consists of a kiln 10 with a cooler 12. A precalciner 14 is connected to the kiln 10 via a riser pipe 16 and to a preheater string including, as shown in the drawing, elements 18, 20, 22, 24, 26 and 28 for preheating the pulverised raw material which is supplied to the top of the preheater. For reasons of simplification, only the lowermost part of the preheater is shown in detail in the drawing. Preheated raw material is fed from the preheater to the precalciner 14 through a pipe 30 and precalcined material is then supplied to the kiln inlet via the separating cyclone 18 and pipe 32. The kiln 10 is provided with a burner 34, and the cooler 12 with an outlet 36 for the product treated in the cooler 12.

A disintegrator or crusher 38 (of a type known to those skilled in the art) is provided for crushing solid fuel supplied at 40. A subsidiary flow of preheated raw material is passed to the disintegrator or crusher 38 through a pipe 42 for mixing with the fuel which is being crushed. The subsidiary flow of raw material, in the embodiment shown in the drawing, is taken from the preheater stage 22 by means of a splitter gate 44. A conveying apparatus 46 (of a type known to those skilled in the art, e.g., a pneumatic or mechanical conveyor) conveys the raw material and crushed fuel mixture to the bottom of the precalciner 14. The raw material and crushed fuel mixture meet the combustion air in an appropriate mixture ratio in the precalciner 14. Inasmuch as the crushed, solid fuel has been mixed with raw material in the disintegrator or crusher 38, no clogging problems occur with respect to the solid fuel either in the disintegrator 38 or in the conveyor 46.

I claim:

1. A method of firing with generally solid fuel in a precalcining zone of a kiln plant for burning pulverous or granular material, the kiln plant including at least one preheater for preheating raw material, comprising mixing the generally solid fuel, with at least a portion of the preheated raw material supplied to the precalcining zone, grinding the generally solid fuel together with said portion of preheated raw material, and feeding the ground mixture of generally solid fuel and preheated raw material to the precalcining zone.

2. The method according to claim 1 wherein the preheated raw material is supplied to the generally solid fuel while being ground.

3. A method of firing with coal in a precalciner of a kiln plant for burning pulverous or granular material, the kiln plant including a preheater string for preheating raw material supplied to the precalciner, comprising, mixing the coal with a portion of the preheated raw material supplied to the precalciner before crushing and crushing the mixture such that said portion of preheated raw material is deposited on the crushed coal as a thin layer so as to prevent agglomeration of the crushed coal, and feeding the mixture of crushed coal and preheated raw material to the precalciner.

4. A plant for burning pulverous or granular material including at least one preheater string for preheating raw material, a kiln for burning the preheated raw material, a cooler for cooling the product treated in the kiln, and a precalcining zone associated with said preheater string for precalcining preheated raw material from the preheater before passage to the kiln, the precalcining zone being fired by generally solid fuel, comprising means for grinding the generally solid fuel, means for simultaneously mixing the generally solid fuel with at least a portion of the preheated raw material from said preheater, and means for feeding the mixture of ground generally solid fuel and preheated raw material to the precalcining zone.

5. The kiln plant according to claim 4 wherein the preheated raw material is supplied to the generally solid fuel while being ground.

6. A kiln plant supplied with raw material for burning pulverous or granular material including a preheater string for preheating raw material, a kiln for burning the preheated raw material, a cooler for cooling the product treated in the kiln, and a coal-fired precalciner configured and adapted for receiving and precalcining preheated raw material from the preheater before passage to the kiln, comprising means for crushing the coal, means for simultaneously mixing the coal with a portion of the preheated raw material such that said portion of preheated raw material is deposited as a thin layer on the crushed coal so as to prevent agglomeration of the crushed coal, and means for feeding the mixture of crushed coal and preheated raw material to said precalciner.

7. The kiln plant according to claim 6 wherein said crushing means is in the form of a disintegrator.

8. The kiln plant according to claim 7 wherein said means for mixing said preheated raw material with the coal includes a splitter gate in communication with the preheater, the precalciner and the disintegrator, the splitter gate being adapted for directing a predetermined portion of the preheated raw material to said disintegrator.

9. The kiln plant according to claim 8 wherein said means for feeding the crushed coal and preheater raw material is at least one of a pneumatic and a mechanical conveyor.

10. A method of firing with solid fuel in the precalcining zone of a kiln plant for burning pulverous or granular material, the plant comprising a preheater with appertaining precalcining zone, a kiln and a cooler coupled after the kiln for cooling the product treated in the kiln, characterized in that the solid fuel prior to being passed to the precalcining zone is crushed in a disintegrator, a subflow of preheated raw material from the preheater being simultaneously supplied to the disintegrator for mixing with the generally solid fuel in the disintegrator whereupon the mixture of generally solid fuel and raw material is fed to the precalcining zone.

11. A kiln plant for firing with generally solid fuel in a precalcining zone of the kiln plant for burning pulverous or granular material, the plant including a preheater for preheating raw material with appertaining precalcining zone, a kiln and a cooler coupled after the kiln for cooling the product treated in the kiln, characterized in that the plant comprises a disintegrator for crushing the generally solid fuel, the disintegrator being provided immediately before the precalcining zone, means for conveying part of the raw material preheated in the preheater from a preheater step before the precalcining zone to the disintegrator for mixing with the generally solid fuel during the crushing process in the disintegrator, and means for passing the mixture of crushed generally solid fuel and preheated raw material from the disintegrator into the precalcining zone.

* * * * *